US006902425B2

(12) United States Patent
Huang

(10) Patent No.: US 6,902,425 B2
(45) Date of Patent: Jun. 7, 2005

(54) ELECTRICAL CONNECTOR FOR FLEXIBLE PRINTED CIRCUIT BOARD

(75) Inventor: Chien Hsun Huang, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/898,467

(22) Filed: Jul. 23, 2004

(65) Prior Publication Data

US 2005/0020125 A1 Jan. 27, 2005

(30) Foreign Application Priority Data

Jul. 23, 2003 (TW) ..... 92213446 U

(51) Int. Cl.[7] ..... H01R 12/24
(52) U.S. Cl. ..... 439/495; 439/607
(58) Field of Search ..... 439/607, 610, 439/495–499, 260

(56) References Cited

U.S. PATENT DOCUMENTS

| | | | | | |
|---|---|---|---|---|---|
| 4,718,859 | A | * | 1/1988 | Gardner | 439/329 |
| 5,470,246 | A | * | 11/1995 | Mosquera | 439/260 |
| 5,580,272 | A | | 12/1996 | Yamaguchi et al. | |
| 5,695,359 | A | | 12/1997 | Fujikura et al. | |
| 5,695,360 | A | | 12/1997 | Seto et al. | |
| 5,738,545 | A | * | 4/1998 | Igarashi et al. | 439/607 |
| 5,941,725 | A | * | 8/1999 | Brennan et al. | 439/357 |
| 6,071,149 | A | * | 6/2000 | Hara | 439/607 |
| 6,238,227 | B1 | * | 5/2001 | Wu et al. | 439/260 |
| 6,280,217 | B1 | | 8/2001 | Lin | |
| 6,283,779 | B1 | * | 9/2001 | Lung | 439/260 |
| 6,561,843 | B1 | | 5/2003 | Ma et al. | |
| 6,762,940 | B2 | * | 7/2004 | Zaremba | 361/728 |
| 2003/0186580 | A1 | * | 10/2003 | Dambach et al. | 439/497 |
| 2004/0248447 | A1 | * | 12/2004 | Aoki | 439/260 |

* cited by examiner

*Primary Examiner*—Tho D. Ta
*Assistant Examiner*—Larisa Tsukerman
(74) *Attorney, Agent, or Firm*—Wei Te Chung

(57) ABSTRACT

An electrical connector (1) includes an insulative housing (2) and a plurality of terminals (3) received in the housing. The housing has a front end with an opening for receiving an end of the FPC in engagement with contacting portions of the terminals, and a back end with a plurality of T-shaped protrusions (202), and a side end with two latching arms (21). An actuator (4) is pivotably mounted relative to the housing for floating movement between a first position allowing free insertion of the FPC into the opening and a second position biasing the FPC against the terminals. A shielding (5) is engaged with the back end and two latching arms of the housing for protecting the connector from Electro Magnetic Interference (EMI) during transferring signals between the FPC and the PCB by the connector. The shielding can also reinforce the strength of the housing.

5 Claims, 4 Drawing Sheets

ELECTRICAL CONNECTOR FOR FLEXIBLE PRINTED CIRCUIT BOARD

CROSS-REFERENCE TO RELATED APPLICATION

The present invention relates to a co-pending U.S. Design Patent Application Ser. No. 29/191,239 filed on Oct. 1, 2003, entitled "FLEXIBLE PRINTED CIRCUIT BOARD CONNECTOR", invented by CHIEN HSUN HUANG, and assigned to the same assignee as the present invention.

BACKGROUD OF THE INVENTION

1. Field of the Invention

The present invention relates to electrical connectors, and more particularly to a flexible printed circuit (FPC) connector for electrically interconnecting a printed circuit board (PCB) with an electrical interface such as a flexible printed circuit (FPC) board.

2. Description of the Prior Art

Flexible printed circuit connectors are widely used in electronic devices such as mobile telephones, keyboards, hard disk drives and fax machines etc. Such kind of FPC connectors is disclosed in "History of FFC/FPC" (Connector Specifier, February 2001, pp.18–20). The FPC connector comprises a housing, a plurality of terminals received in the housing, and an actuator rotatably mounted on the housing. Each terminal has a bifurcate contact section and a solder tail soldered onto a PCB. One end of an FPC board is inserted into an opening defined in the housing, for engaging the bifurcate contact sections of the terminals. Thus, mechanical and electrical engagement between the PCB and the FPC board is attained.

With the miniaturization of electronic system and the development of high-frequency signal transmission technology, An FPC connector used in such system needs to reliably transmit high-frequency signals. A shielding is commonly required to provided for the FPC connector, to prevent Electro Magnetic Interference (EMI) in relation to the external environment. Thus a reliable transmission of high-frequency signals within the system is ensured.

Conventional FPC connectors are disclosed in U.S. Pat. Nos. 5,580,272, 5,695,359 and 5,695,360. These connectors mainly comprise a housing, a plurality of terminals received in the housing, an actuator pivotably mounted on the housing, for pressing an FPC board against the terminals and solder pads mounted to the housing. However, these connectors have a shortcoming that there is no shielding means in these structures. When transmitting high-frequency signals, these connectors cannot provide effective EMI shielding. This thereby can effect a reliable transmission of the signals.

When the actuator is pivotably mounted on the housing at an open position, the FPC board is inserted into the housing with a zero insertion force (ZIF) thereby uniform pre-contact between the FPC board and the terminals. After that, the actuator is rotatable from the open position to a closed position thereby the actuator press the FPC board to engage with the terminals. Thus electrical engagement between the FPC board and the connector is attained. Because the housing is commonly formed from plastic material and only a part of the housing engaged with the actuator, after the actuator pivotably rotating round the housing for a long time, the housing crack from a portion connecting with the actuator. Thus, reliability mechanical and electrical engagement between the FPC board and the connector is decreased.

In view of the above, a new electrical connector that overcome above-mentioned disadvantages is desired.

SUMMARY OF THE INVENTION

Accordingly, a main object of the present invention is to provide an electrical connector for electrically connecting a sheet-like connection member such as a flexible printed circuit (FPC) or a flat cable with a circuit substrate such as a printed circuit board (PCB), and particularly to provide a connector that has an Electro Magnetic Interference (EMI) shielding to ensure reliable signal transmission between an FPC and a PCB.

Another object of the present invention is to provide an electrical connector, whereby the connector can reinforce a housing of the connector.

To achieve the above objects, an electrical connector in accordance with a preferred embodiment of the present invention is provided for electrically connecting an FPC or an FFC with a PCB. The connector comprises an elongated insulative housing, a plurality of electrical terminals received in the housing, an actuator pivotably mounted on the housing, and a shielding mounted on the housing, functioning as an EMI device. The housing comprises a main body and a pair of latching arms extending from two opposite ends of the main body. The main body has a lower surface and an upper surface opposite to the lower wall, and a plurality of passageway disposed between the lower surface and the upper surface, for receiving the corresponding terminals therein, respectively. A plurality of securing protrusions with T-shaped is formed on the main body, and a pair of grooves is defined in the main body. The shielding substantially surrounds the upper surface of the housing. A plurality of T-shaped securing slots is defined in the shielding, for engaging with the securing protrusions of the housing. A pair of grounding tabs extends from two opposite ends of the shielding, partly retained in the respective grooves of the housing, for mating with corresponding grounding pads of a PCB. A pair of clasping portions is formed on the shielding, surrounding the latching arms of the housing. This can also reinforce the strength of the housing.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
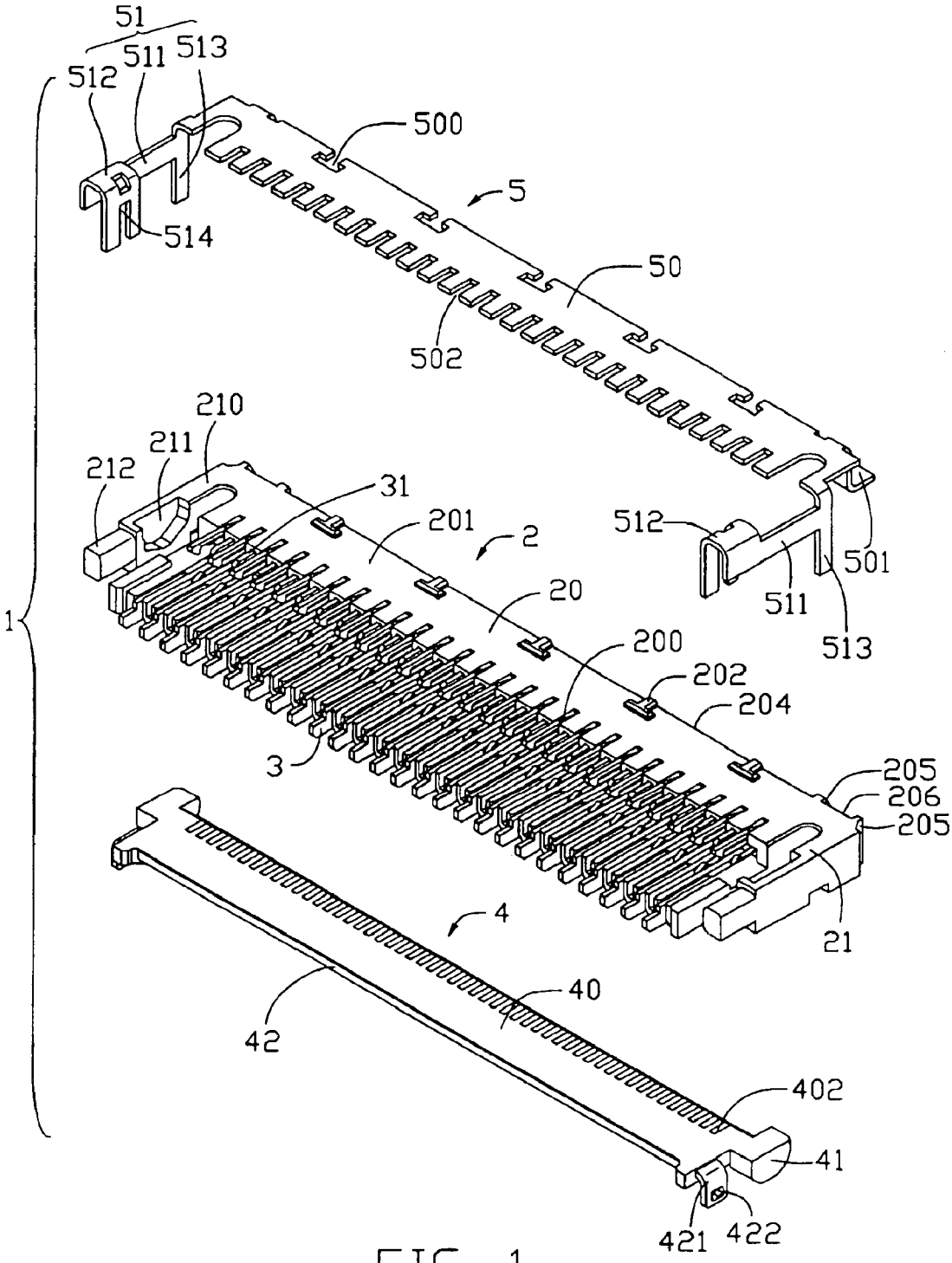
FIG. 1 is an exploded, isometric view of an FPC connector in accordance with the preferred embodiment of the present invention.
Figure 3:
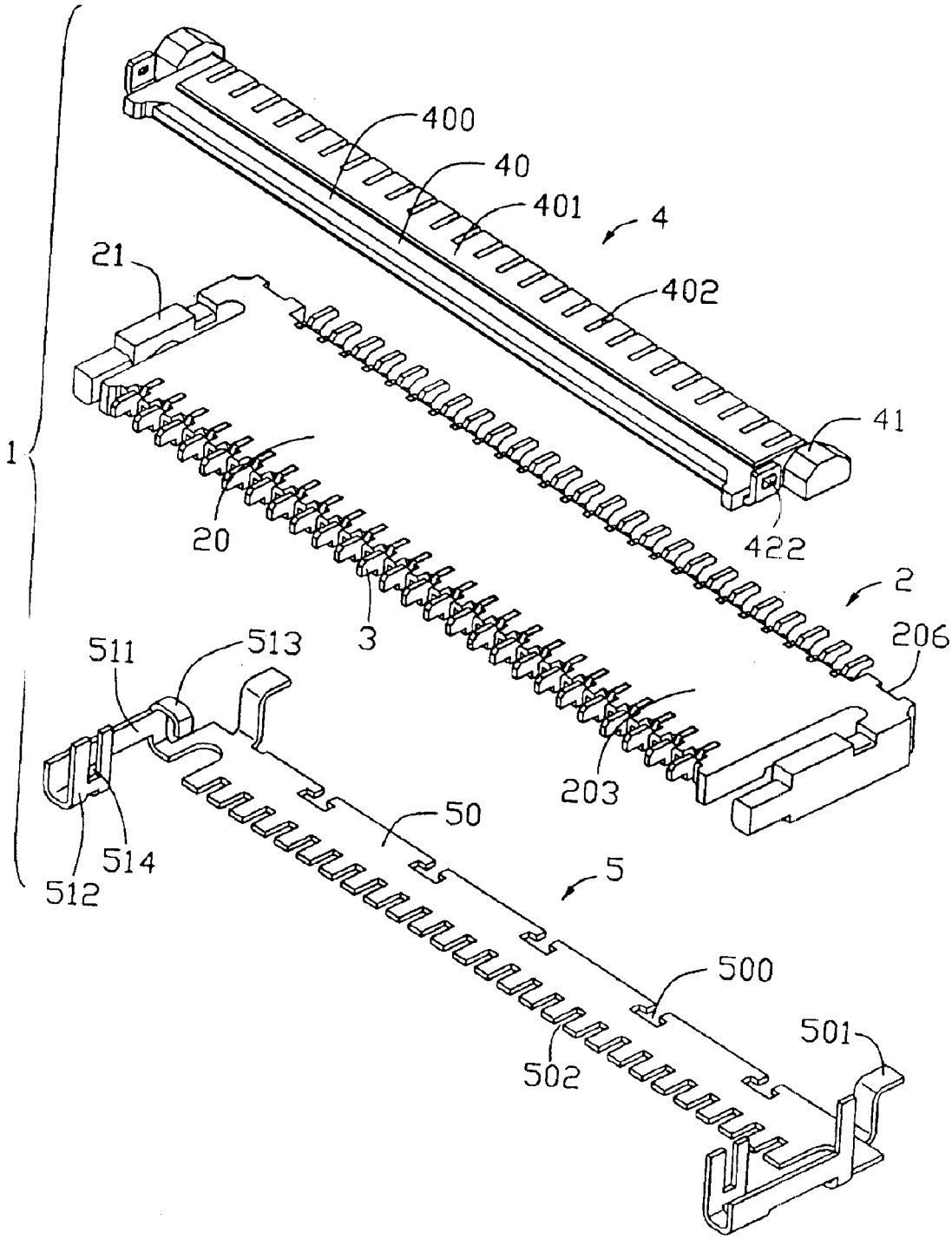
FIG. 3 is similar to FIG. 1, but viewed from another aspect.

Referring to FIGS. 1 and 3, an electrical connector 1 of the preferred embodiment of the present invention is provided for electrical connecting a sheet-like connection member such as a flexible printed circuit board (FPC) or a flexible flat cable (FFC) (not shown) with a circuit substrate such as a printed circuit board (PCB) (not shown). The connector 1 comprises an insulative housing 2, a plurality of electrical terminals 3 received in the housing 2, an actuator 4 rotatably mounted on the housing 2, and a shielding 5 attached to the housing 2.

The housing 2 is configured with a longitudinal main body 20, and a pair of latching arms 21 extends from two opposite sides of the main body 20. A plurality of spaced passageways 200 is defined in the main body 20, for receiving the corresponding terminals 3 therein, respectively. The main body 20 has a top surface 201, a bottom surface 203 opposite to the top surface 201, and a sidewall 204 connecting the top and the bottom surfaces 201, 203. The bottom surface 203 engages with the PCB, for fixing the connector on the PCB. A plurality of spaced protrusions 202 are formed on a back portion of the top surface 201 and arranged along a longitudinal direction. The protrusions 202 have a substantially "T" shaped configuration. A pair of tenons 205 is outwardly formed on two opposite end sides of the sidewall 204 respectively. A groove 206 is defined between each pair of tenons 205 therethrough. The side latching arms 21 each have a first arm 210 connecting with the main body 20, and a smaller second arm 212 extending forwardly from a front end of the first arm 210. A recess 211 is defined inwardly at one end portion of the first arm 210 near the second arm 212.

The actuator 4 is pivotably mounted on the housing 2 and comprises a base portion 40, a pair of latch blocks 41 formed outwardly on two opposite sides of the base portion 40, and a metal sheet 42 longitudinally inlayed in the base portion 40, for reinforcing the strength of the base portion 40. A pressing surface 400 is formed on a bottom of the base portion 40, for pressing the FPC against the terminals 3 (referring to FIG. 3). A convex 401 is protruded outwardly from the pressing surface 400 (referring to FIG. 3). A plurality of channels 402 is defined in the convex 401, for accommodating the terminals 3 therein when the actuator 4 being mounted and pressed onto the housing 2. The metal sheet 42 has a main portion (not labeled) and a pair of ears 421 extending and bending downwardly from two opposite sides of the main portion. The main portion is enchased within the base portion 40. A protuberance 422 is formed outwardly on a middle portion of each of the ears 421. The latch blocks 41 are configured to rotatably retain in the recess 211 of the respective latching arms 21, and thereby mounting the actuator 4 to the housing 2 pivotably.

The shielding 5 is engaged with the housing 2 and has a planar plate portion 50, and a pair of side clasping portions 51 extending forwardly from two opposite sides of the plate portion 50. A plurality of "T" shaped securing slots 500 is defined in a back portion of the plate portion 50 therethough vertically. The slots 500 engage with the respective T-shaped protrusions 202 of the housing 2, for positioning the plate portion 50 on the top surface 201 of the housing 2. A pair of grounding tabs 501 extends downwardly from a back longitudinal side of the plate portion 50, partly received in the respective grooves 206 of the housing 2. The grounding tabs 501 each have a cantilever configuration. A mating portion (not labeled) is formed at a free end of the grounding tabs 501 each, for mating with the corresponding grounding pads of the PCB. A plurality of indents 502 is defined in a front portion of the plate portion 50, perpendicular to and run through the plate portion 50 vertically. The indents 502 are above on and each communicate with the respective first passageways 200, for avoiding the shielding 5 contacting with the terminals 3. The clasping portion 51 each have a base portion 511, a clasper 512 formed on the base portion 511 opposite to the plate portion 50, and a strip clip 513 extending from the base portion 511 near the plate portion 50. The clasper 512 extends and bends downwardly from a top edge of the base portion 511. A cutout 514 is defined downwardly in the clasper 512, for engaging with the respective protuberances 422 of the actuator 4.

Figure 2:
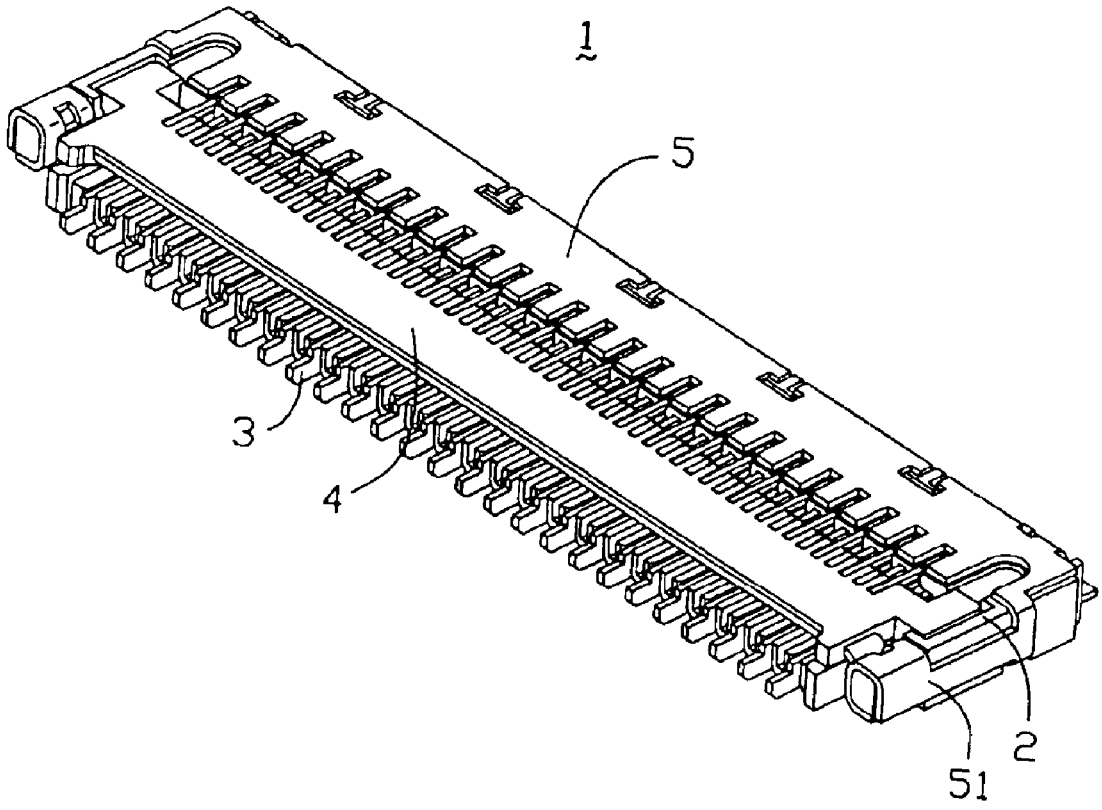
FIG. 2 is an assembled view of FIG. 1, showing a pressing member of the FPC connector at a closed position.
Figure 4:
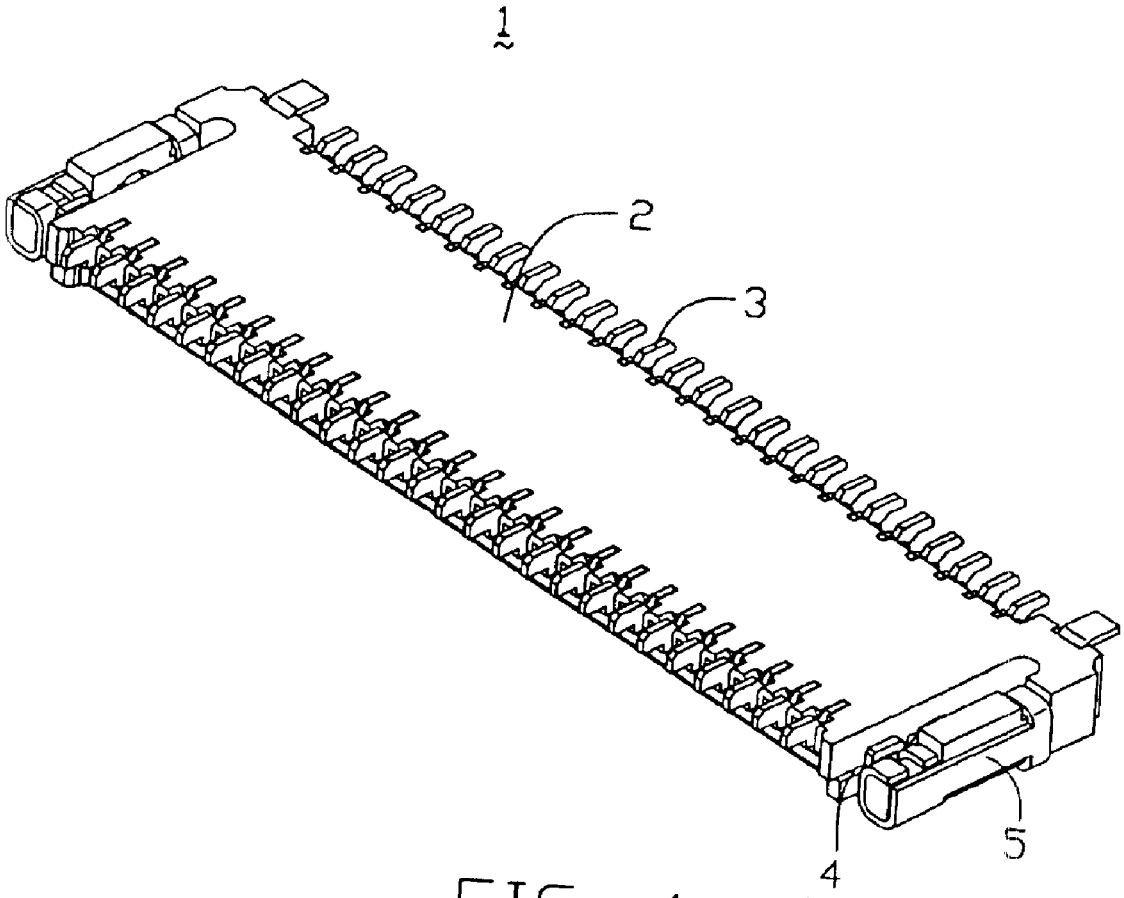
FIG. 4 is similar to FIG. 2, but viewed from another aspect.

Referring also to FIGS. 2 and 4, in assembly, the terminals 3 are inserted into and retained in the respective passageways 200 of the housing 2. Then the shielding 5 is attached to the housing 2. The protrusions 202 of the housing 2 are locked into the respective slots 500 of the shielding 5, to thereby position the shielding 5 on the top surface 201 of the housing 2. The grounding tabs 501 are partly retained in the corresponding grooves 206 of the housing 2, the mating portion thereof mating with the corresponding grounding pads of the PCB. Thus effective EMI protection is attained throughout the connector 1. The clasper 512 and the strip clip 513 of clasping portion 51 embrace the first and second arm 212, 210 of the latching arms 21, respectively. The base portion 511 of the clasping portion 51 abuts against outside wall (not labeled) of the latching arm 21. This adversely can reinforce the strength of the latching arm 21 of the housing 2. Finally, the latch blocks 41 of the actuator 4 are rotatably inserted into the recess 211 of the latching arms 21. Thus, the actuator 4 is mounted to the housing 2 pivotably.

In use, the actuator 4 is firstly rotated to a vertical position stated as an open position. Then the FPC board is inserted into an opening (not labeled) of the housing 2 with zero insertion force (ZIF) from a front of the housing 2, at that time the pads of the FPC board not engaging with the respective terminals 3. When the FPC board is inserted completely into the opening of the housing 2, and the actuator 4 is rotated downwardly from the vertical position to a horizontal position stated as a closed position, where the pressing surface 400 of the actuator 40 urges the FPC board to engage with the terminals 3. During the rotation, the protuberances 422 of the actuator 4 are locked into the corresponding cutouts 514 of the shielding 5, thereby the actuator 4 to hold at the horizontal position. As a result, the actuator 4 is firmly situated at the closed position, and liability mechanical and electrical engagement between the FPC board and the connector 1 is attained.

In the connector 1 of the present invention, the shielding 5 is attached to the housing 2, the slots 500 thereof engaging with the protrusions 202 of the housing 2 thereby the shielding 5 substantially surrounding the housing 2. Thus, EMI protection in housing 2 is established. Additionally, the grounding tabs 501 extend from the shielding 5, partly retained in the grooves 206 of the housing 2. The mating portion of the grounding tabs 501 mates with the corresponding grounding pads of the FPC board. This can reduces the static electricity accumulated in the shielding 5. As a result, complete EMI protection throughout the connector 1 is provided. Furthermore, The plate portion 50 of the shielding 5 covers the main body 20 of the housing 2, and the clasping portions 51 embrace the latching arms 21 of the housing 2. This can prevent the housing 2 from damage caused by external forces, and thereby to reinforce the strength of the housing 2.

While a preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector for electrically connecting a flexible substrate with a printed circuit board (PCB), the connector comprising:

an insulative housing defining a main body and two latching arms extending from two opposite ends of the main body, a plurality of protrusions formed on a back portion of the main body and arranged along a longitudinal direction;

a plurality of terminals received in the housing;

an actuator pivotably engaging with the housing; and a shielding mounted on the housing, the shielding comprising a plate portion and a pair of clasping portions extending forwardly from two opposite sides of the plate portion, the plate portion defining a plurality of securing slots engaged with the protrusions of the housing;

the clasping portions engaged with the latching arms, wherein the plate portion defining a plurality of spaced indents on a front thereof and the clasping portion comprises a base portion, a clasper formed on the base portion opposite to the plate portion, and a strip clip extending from the base portion near the plate portion; and the clasper extends and bends downwardly from a top edge of the base portion, and a cutout is defined downwardly in the clasper.

2. The electrical connector as claimed in claim 1, wherein the securing slots of the shielding and the protrusions of the housing have a substantially "T" shaped configuration.

3. The electrical connector as claimed in claim 2, wherein the protrusion is formed on a top surface of the housing.

4. The electrical connector as claimed in claim 1, wherein a pair of grounding tabs extends downwardly from a back longitudinal side of the plate portion.

5. The electrical connector as claimed in claim 1, wherein the actuator comprises a base portion, a pair of latch blocks formed outwardly on two opposite sides of the base, and a metal sheet longitudinally formed in the base portion, a pair of ears extending from the metal sheet, a locking protuberance formed on a middle portion of each of the ears and received in the cutout of the shielding.

* * * * *